US006734781B1

(12) United States Patent
Nagashima

(10) Patent No.: US 6,734,781 B1
(45) Date of Patent: May 11, 2004

(54) MOUNTING STRUCTURE FOR TEMPERATURE-SENSITIVE FUSE ON CIRCUIT BOARD

(75) Inventor: Mitsunori Nagashima, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/646,906

(22) PCT Filed: Apr. 30, 1999

(86) PCT No.: PCT/JP99/02360

§ 371 (c)(1),
(2), (4) Date: Oct. 10, 2000

(87) PCT Pub. No.: WO99/60828

PCT Pub. Date: Nov. 25, 1999

(51) Int. Cl.[7] ..... H01H 85/044; H01H 85/046

(52) U.S. Cl. ..... 337/297; 337/405; 337/290; 337/159

(58) Field of Search ..... 337/297, 290, 337/295, 296, 159, 401–405, 416; 29/623

(56) References Cited

U.S. PATENT DOCUMENTS

| | | | | | |
|---|---|---|---|---|---|
| 3,649,942 | A | * | 3/1972 | Plasko | 337/163 |
| 4,477,857 | A | * | 10/1984 | Crocker | 361/104 |
| 4,652,848 | A | * | 3/1987 | Hundrieser | 337/297 |
| 5,097,247 | A | * | 3/1992 | Doerrwaechter | 29/623 |
| 5,586,014 | A | * | 12/1996 | Hasegawa | 361/142 |
| 5,708,553 | A | * | 1/1998 | Hung | 337/114 |
| 5,712,610 | A | * | 1/1998 | Takeichi et al. | 337/290 |
| 6,198,376 | B1 | * | 3/2001 | Ishikawa et al. | 337/159 |
| 6,232,868 | B1 | * | 5/2001 | Rehnelt | 338/195 |

FOREIGN PATENT DOCUMENTS

| | | | | |
|---|---|---|---|---|
| EP | 0 732 107 | | 9/1996 | |
| GB | 2 302 451 | | 1/1997 | |
| JP | 10-275548 A | * | 10/1998 | H01H/37/76 |
| JP | 2000-31620 A | * | 1/2000 | H05K/1/18 |
| JP | 2000-76971 A | * | 3/2000 | H01H/37/76 |
| JP | 2001-222938 A | * | 8/2002 | H01H/37/76 |

* cited by examiner

*Primary Examiner*—Anatoly Vortman
(74) *Attorney, Agent, or Firm*—Arent Fox PLLC

(57) ABSTRACT

Electronic components are integrated onto the front surface of a circuit board 1 having an interconnection pattern formed thereon. In the vicinity of a particular electronic component (FET) 2 among those components that is likely to generate heat, a thermal fuse 4 is provided for breaking circuit when the temperature of this electronic component increases. In the circuit board 1, a through opening 1*a* is provided in the area where the FET 2 is located. The FET 2 is attached to the front surface of the circuit board 1 to extend across the through opening 1*a*. On the rear side of the FET 2, the thermal fuse 4 is attached to partially enter the through opening 1*a* via a heat-conducting resin 3 such as silicone resin. This structure thus obtained for mounting the thermal fuse on the circuit board enables reduction of the thickness to the surface of mounted components without thinning the circuit board, enables a thermal fuse to be mounted on any circuit board which is to be housed in an extremely small space like the one in a notebook computer, and ensures breaking of circuit when abnormality occurs by sensitively detecting the temperature of any component which readily increases in temperature.

3 Claims, 3 Drawing Sheets

MOUNTING STRUCTURE FOR TEMPERATURE-SENSITIVE FUSE ON CIRCUIT BOARD

TECHNICAL FIELD

The present invention relates to a structure for mounting a thermal fuse on a circuit board, for example, a structure for mounting an axial type thermal fuse on a circuit board placed in a small space like a circuit board contained in a battery casing of a notebook computer or the like. More specifically, the invention relates to a structure for mounting a thermal fuse on a circuit board in which the thermal fuse is attached to sensitively detect the temperature of any component as its temperature increases and which enables reduction of the total thickness of the circuit board including mounted components.

BACKGROUND ART

A battery casing of a notebook computer contains, as shown in FIG. 2 for example, a rechargeable battery such as lithium ion battery or the like encased in a battery housing 22 in a resin case 21. In a narrow space between battery housing 22 and an end of resin case 21, an electric circuit board 23 is housed. Electric circuit board 23 has components formed thereon such as a protection circuit for preventing overcharge of the rechargeable battery as well as explosive breakdown due to short-circuit.

Onto circuit board 23, a thermal fuse is integrated in the vicinity of any electronic component such as FET which readily generates heat when overcurrent flows due to occurrence of abnormality on a circuit. Circuit board 23 is thus provided with means for preventing such an accident by breaking the circuit when the temperature abnormally increases.

In a conventional mount structure for a circuit board having such a thermal fuse, as shown in FIGS. 3A and 3B for example, a silicone resin 33 is applied onto a board 31 to reach an FET 32 thereby facilitate heat conduction from FET 32 which readily generates heat. An axial type thermal fuse 34 is mounted on silicone resin 33 to be embedded therein and connected in series to the circuit. Therefore, when viewed from the side of thermal fuse 34, silicone resin 33 is higher than thermal fuse 34 while thermal fuse 34 is surrounded by silicone resin 33 with the upper surface of thermal fuse 34 being exposed.

As discussed above, in the conventional mount structure having the thermal fuse integrated onto the circuit board, the silicone resin for temperature transmission is applied onto the board, the thermal fuse is mounted on the silicone resin and accordingly, the thickness (H in FIG. 3B) from the board increases.

A resultant problem is, for such a use as the one which requires the thickness H from the board to be 4 mm or less like a thin circuit board or the like used for the battery casing of the notebook computer described above, a considerable difficulty in dimensioning the circuit board in such a range because the diameter D of the thermal fuse is approximately 2 mm, leading to deterioration of working efficiency.

The entire thickness could be reduced by decreasing the thickness of board 31. However, currently the board is approximately 0.8 mm in thickness, and further thinning of the board would cause warp thereof. Consequently, the mounting work becomes troublesome in manufacture and the cost of the board increases.

The present invention is made to solve these problems. One object of the invention is to provide a mount structure for a thermal fuse on a circuit board, which enables reduction of the thickness to the surface of mounted components without thinning the board, allows a thermal fuse to be mounted on a circuit board housed in a considerably small space such as the one in a notebook computer, and further enables circuit to be broken surely when any abnormality occurs by sensitively detecting the temperature of any component which is likely to increase in temperature.

DISCLOSURE OF THE INVENTION

According to the present invention, a mount structure for thermal fuse on circuit board includes a circuit board, a through opening, an electronic component and a thermal fuse. The circuit board has one surface on which a predetermined circuit is formed. The through opening is provided in the circuit board. The electronic component is attached to the one surface of the circuit board to extend across the through opening. The thermal fuse is provided on the other surface of the circuit board to enter the through opening, responding to the temperature of the electronic component via a heat-conducting insulating member filling the through opening for breaking the predetermined circuit. In particular, the electronic component here refers to an electronic component such as power FET for example having its temperature remarkably increased when any abnormality such as overcurrent occurs.

In this structure, the electronic component is attached to one surface of the circuit board to extend across the through opening provided in the circuit board, and for this particular electronic component, the thermal fuse is provided on the other surface of the circuit board to enter the through opening. In this way, it is possible to reduce the thickness of the entire assembly. The temperature of the electronic component is conducted to the thermal fuse via the heat-conducting insulating member filling the through opening. Accordingly, any temperature increase of the particular electronic component can be monitored sensitively, which ensures breaking of the circuit in the event of temperature increase.

Specifically, the heat-conducting insulating member described above is preferably silicone resin.

Preferably, a through hole is provided in the circuit board and the thermal fuse is electrically connected to the predetermined circuit via the through hole.

In this case, the thermal fuse attached to the other surface of the circuit board can readily be connected to the circuit formed on one surface of the circuit board.

Further, the thermal fuse preferably includes therein a rod-shaped fuse.

In this case, depending on use or heat-conducting state between the fuse and the electronic component, the diameter of the rod-shaped fuse can be changed to easily control the temperature at which the circuit is to be broken.

BEST MODES FOR CARRYING OUT THE INVENTION

Figure 1A:
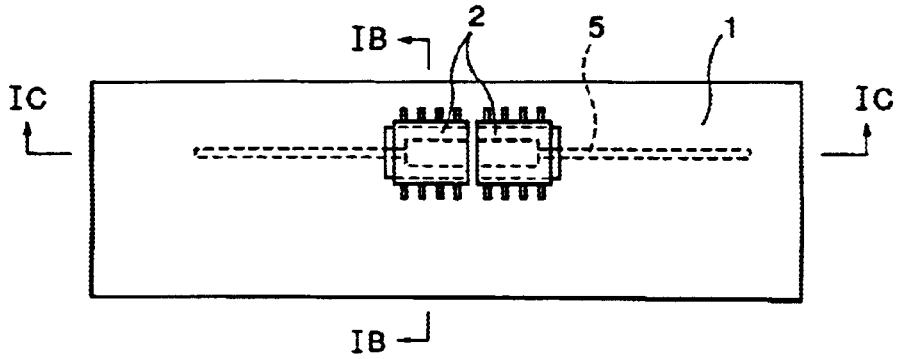
FIG. 1A is a plan view illustrating a structure for mounting a thermal fuse on a circuit board according to the present invention.
Figure 1B:
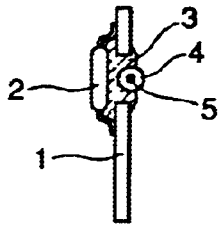
FIG. 1B is a transverse cross section along IB—IB in FIG. 1A.
Figure 1C:
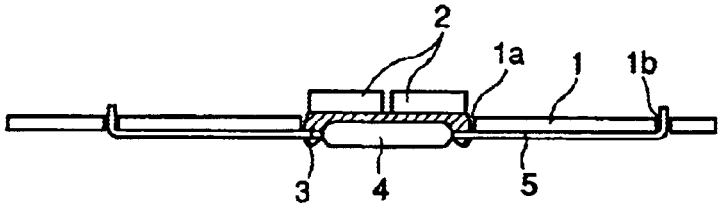
FIG. 1C is a longitudinal cross section along IC—IC in FIG. 1A.
Figure 1D:
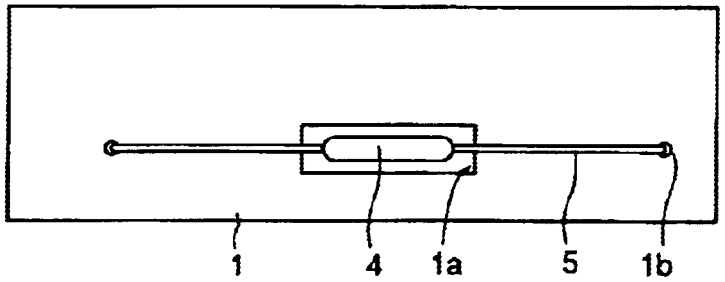
FIG. 1D is a rear view illustrating the structure for mounting the thermal fuse on the circuit board according to the present invention.
Figure 2:
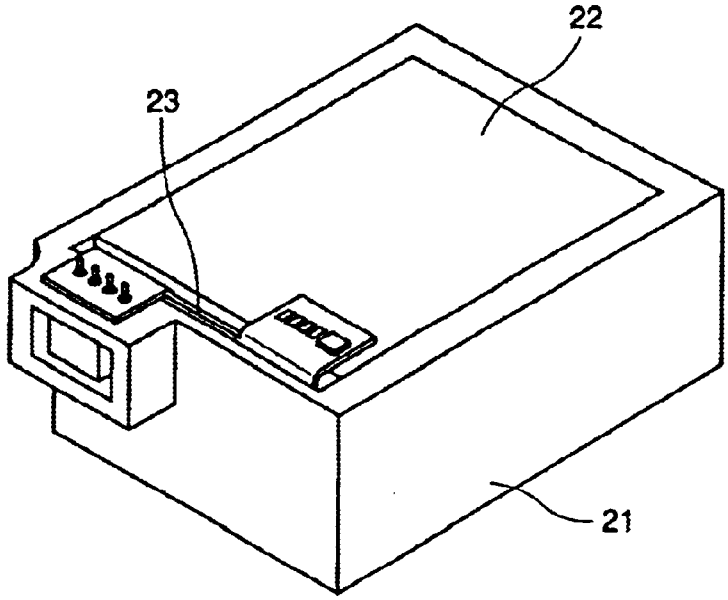
FIG. 2 PRIOR ART
FIG. 2 is a perspective view illustrating one example of a battery casing of a notebook computer.
Figure 3A:
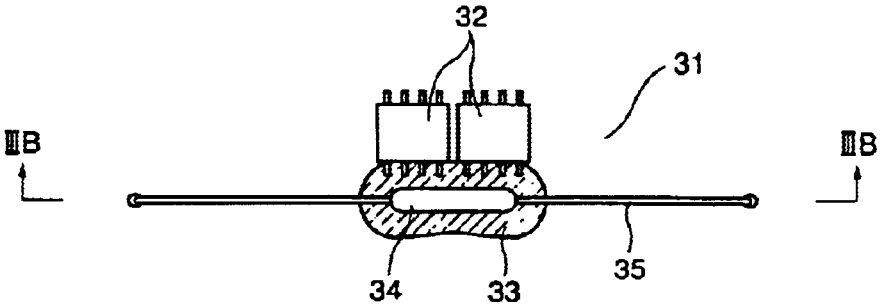
FIG. 3A PRIOR ART
FIG. 3A is a plan view illustrating a conventional structure for mounting a thermal fuse on a circuit board.
Figure 3B:
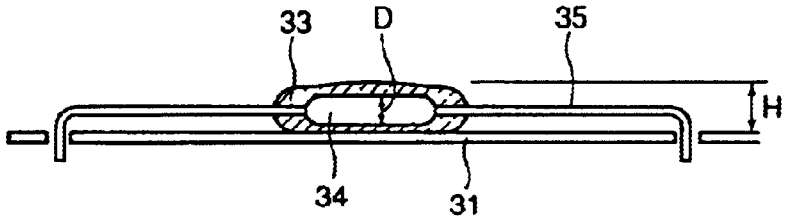
FIG. 3B PRIOR ART
FIG. 3B is a longitudinal cross section along IIIB—IIIB in FIG. 3A.

Referring to the drawings, description is now given of a structure for mounting a thermal fuse on a circuit board according to the present invention. As shown in FIGS. 1*a* to 1*d,* in the mount structure for a thermal fuse on a circuit board according to the invention, an electronic component is integrated onto the surface of a board 1 where an interconnection pattern (not shown) is formed. It is noted that other electronic components are not shown in the drawings. In the vicinity of a particular one of these electronic components that readily generates heat, an FET 2 for example, a thermal fuse 4 is provided to break circuit when the temperature of the electronic component increases.

According to the present invention, a through opening 1*a* is provided in board 1 such that it is located at the portion where the particular electronic component (FET) 2 is placed. FET 2 is attached to the front surface of board 1 to extend across through opening 1*a*. On the rear side of FET 2, thermal fuse 4 is attached to partially enter through opening 1*a* via a heat-conducting resin 3 such as silicone resin, for example.

A lead 5 on either end of thermal fuse 4 is connected from the rear surface of board 1 to an interconnection (not shown) formed on the front surface of board 1 via a through hole 1*b* provided in board 1.

For circuit board 1, a printed board or the like may be used that is formed of epoxy, glass epoxy, paper epoxy or the like for example and has interconnection printed on its surface. Through hole 1*b* for inserting therein a lead of any electronic component such as thermal fuse as well as through opening 1*a* are collectively punched by using a mold. Through opening 1*a* is provided in advance under the location where FET 2, a particular electronic component which readily increases in temperature, is to be mounted.

Usually board 1 having a thickness of approximately 0.8 mm is used, maintaining a sufficient mechanical strength without warp. A solder paste is applied onto a joint between the electronic component and the interconnection printed on the surface of circuit board 1. On this solder paste, the electronic component such as FET 2 of surface-mount type is placed. The electronic component is mounted accordingly by means of soldering in a reflow furnace or the like.

FET 2 is provided for switching on/off a charge/discharge circuit and is likely to generate heat when overcurrent flows due to any failure. This structure accordingly provides thermal fuse 4 near FET 2 so as to sense the generated heat and break the circuit in the event of heat generation.

For heat-conducting resin 3 as a heat-conducting insulating member, silicone resin or the like may be used similar to the one which has conventionally been employed. Heat conduction is improved by interposing the heat-conducting resin between the electronic component and the thermal fuse. Since thermal fuse 4 is inserted into heat-conducting resin 3 to be embedded therein, heat-conducting resin 3 extends even over the side of thermal fuse 4.

Thermal fuse 4 is of a columnar axial type including therein a rod-shaped fuse, and capable of controlling the temperature for breaking by changing the diameter of the rod-shaped fuse depending on the heat-conduction state between fuse 4 and any heat source. For example, a fuse applied to the battery casing of the notebook computer discussed above is the one which breaks the circuit when the temperature rises to approximately 130° C., for example.

In the mount structure for a thermal fuse according to the invention, through opening 1*a* is provided in board 1 under the particular electronic component (FET) 2 with its temperature increase monitored, and thermal fuse 4 is mounted to partially enter through opening 1*a* via heat-conducting resin. Then, thermal fuse 4 can directly monitor increase of the temperature of the particular electronic component FET 2 in a sensitive manner.

Further, thermal fuse 4 is provided to partially enter through opening 1*a* formed in the board. Consequently, the thickness of the entire board including mounted components is considerably reduced. The height from the board is 1.3 mm or less and accordingly the entire thickness including the board is approximately 4 mm.

Since heat-conducting resin 3 fills the inside of through opening 1*a*, just an extremely small amount thereof is required. Reduction of the amount of applied resin is thus possible and the applying work is made considerably easier. In addition, there is no need to reduce the thickness of the board, which prevents any problem regarding warp of the board or the like. In this way, working efficiency improves and rising of cost is avoided.

Although silicone resin is used here as an exemplary heat-conducting resin, the resin is not limited to the silicone resin and any insulating material may be used if it has a property of conducting heat generated from an electronic component.

The embodiments herein disclosed should be considered as illustration and example in all respects, not to be taken by way of limitation. It is intended that the scope of the invention is defined not by the description above but by the scope of claims and that all modifications are included therein within the meaning and scope equivalent to the scope of claims.

As heretofore discussed, according to the present invention, when the mount structure for a thermal fuse on a circuit board is applied to mounting of a thermal fuse on a circuit board which should be mounted in a considerably small space as the one in a notebook computer or the like, the mount structure ensures monitoring of temperature increase of a particular electronic component without increase of the thickness.

What is claimed is:

1. A mount structure for thermal fuse on circuit board, comprising:

a circuit board having a first surface where a predetermined circuit is formed; and a second surface a through opening provided in said circuit board; the through opening joining the first and second surfaces;

an electronic component attached to the first surface of said circuit board to extend across said through opening;

a thermal fuse provided on the second surface of said circuit board to enter said through opening, responding to temperature of said electronic component via a heat-conducting insulating member filling said through opening for breaking said predetermined circuit; and a through hole provided in said circuit board, wherein said thermal fuse is electrically connected to said predetermined circuit via said through hole, wherein the through opening and the heat-conducting insulating member contained therein are free from electrical conductors in the space between the electronic component and the thermal fuse.

2. The mount structure for thermal fuse on circuit board according to claim 1, wherein said heat-conducting insulating member is silicone resin.

3. The mount structure for thermal fuse on circuit board according to claim 1, wherein said thermal fuse includes therein a rod-shaped fuse.

* * * * *